United States Patent [19]

Kotler

[11] 4,174,646

[45] Nov. 20, 1979

[54] UNIVERSAL TOOL WITH GRIPPING ACTION AND REPLACEABLE JAWS

[76] Inventor: Simon Kotler, 222 E. 8th St., Brooklyn, N.Y. 11218

[21] Appl. No.: 903,555

[22] Filed: May 8, 1978

[51] Int. Cl.[2] ..... B25B 13/18; B25G 1/00

[52] U.S. Cl. ..... 81/128; 81/175; 81/180 R; 30/101; 30/122; 30/241; 7/167; 10/123 R

[58] Field of Search ..... 7/138, 157, 167; 10/123 R; 30/92, 101, 122, 241; 81/128, 164, 169, 175, 180 R, 180 B, 181, 182

[56] References Cited

U.S. PATENT DOCUMENTS

| | | | |
|---|---|---|---|
| 134,440 | 12/1972 | Roache | 81/181 X |
| 330,453 | 11/1885 | Wolfe | 81/175 |
| 425,655 | 4/1890 | Canedy | 81/175 UX |
| 495,793 | 4/1893 | Fletcher | 7/157 X |
| 666,950 | 1/1901 | Wirl | 7/157 |
| 1,335,660 | 3/1920 | Conley | 7/157 |
| 2,076,462 | 4/1937 | Horechney | 81/180 B |
| 2,417,533 | 3/1947 | Wilkison | 81/164 X |

*Primary Examiner*—James G. Smith
*Attorney, Agent, or Firm*—Howard I. Podell

[57] ABSTRACT

A universal tool includes a body with an opening adapted to interchangeably receive cassette-type work elements. Connected to the body is a handle containing clamping means for securing the work piece within the surfaces of the working elements of the cassette and a screw unit which preliminarily orients the working surfaces of the cassette elements in relation to the diameter or size of the work piece. The various cassettes can contain a screw driver, reamers, wrench, pipe flare, thread cutters and other functional working surfaces or jaws.

10 Claims, 22 Drawing Figures

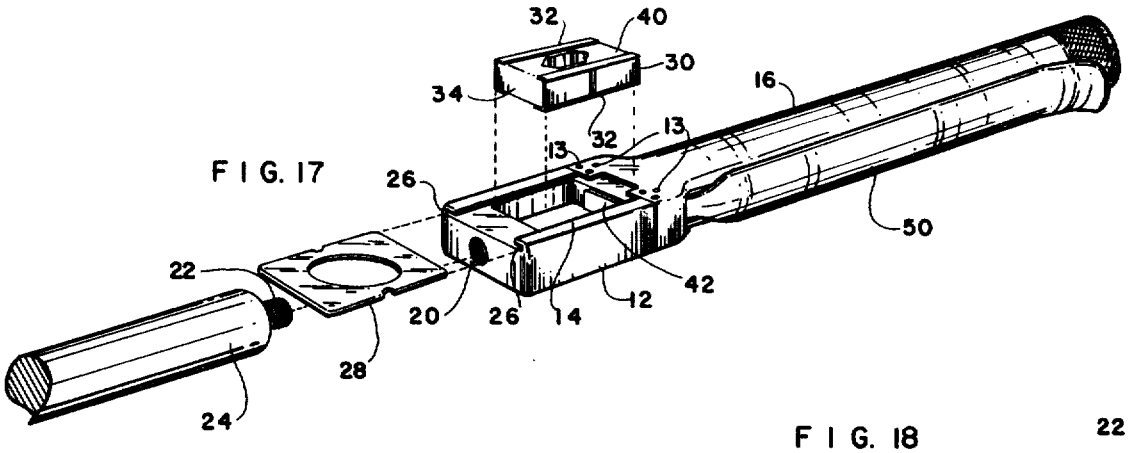
FIG. 17
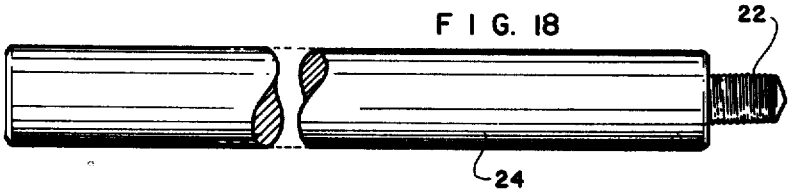
FIG. 18
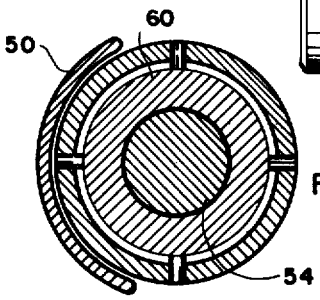
FIG. 19
FIG. 21
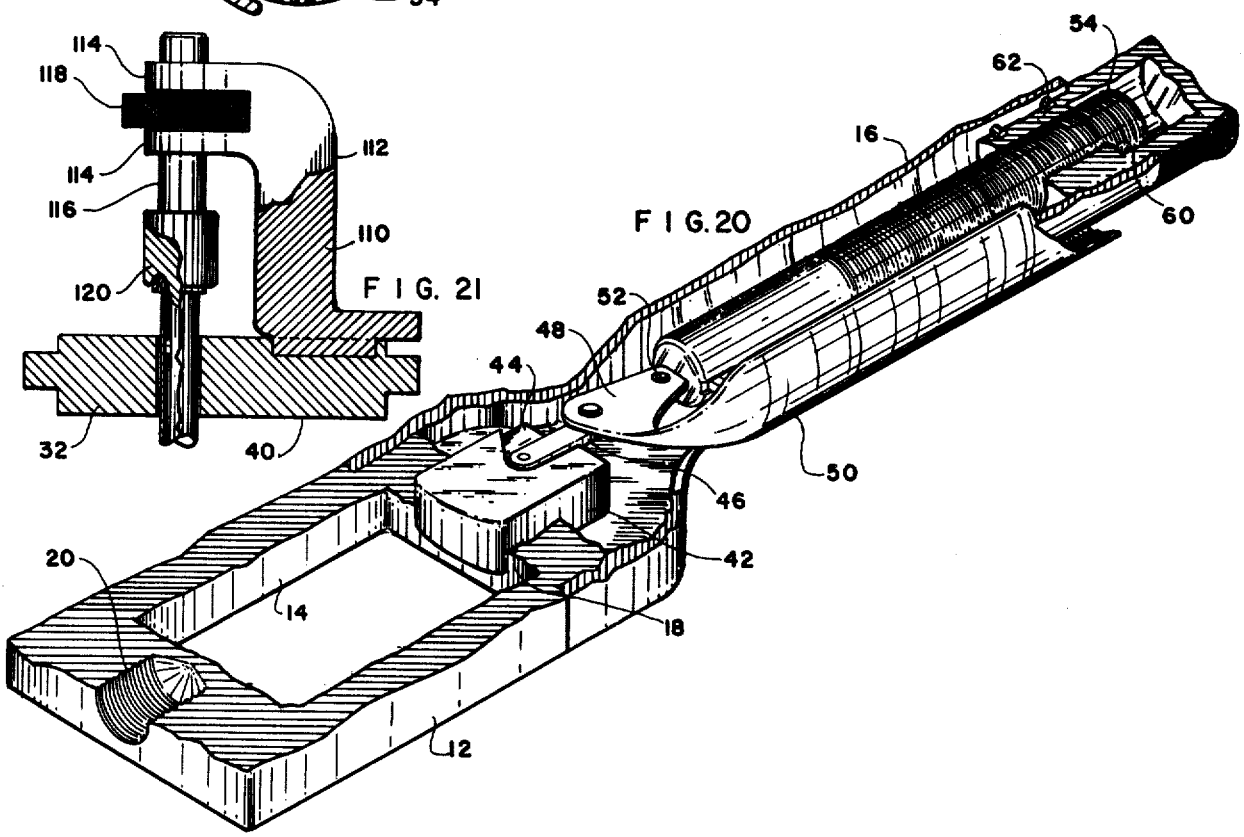
FIG. 20

UNIVERSAL TOOL WITH GRIPPING ACTION AND REPLACEABLE JAWS

FIELD OF THE INVENTION

This invention relates generally to a universal tool with replaceable cassettes for performing torqueing operations.

DESCRIPTION OF THE PRIOR ART

The prior art, as exemplified by U.S. Pat. Nos. 3,875,828; 3,173,317; 2,943,524; 2,827,814; 3,212,317; 1,555,652; 3,161,092; 1,501,329; 1,055,724; 1,132,146; 2,498,235; and 2,486,523 is generally illustrative of the pertinent art but the aforementioned patents are non-applicable to the present invention. While the prior art expedients are generally acceptable for their intended purposes only, they have not proven entirely satisfactory in that they are either complex and expensive to manufacture, or bulky and inconvenient to use, or require unusual dexterity to operate. As a result of the shortcomings of the prior art, typified by the above, there has developed a substantial need for improvement in this field.

The principal object of this invention is to provide a device or article of this character which combines simplicity, strength and durability in a high degree, together with inexpensiveness of construction owing to a minimum of parts so as to encourage widespread use thereof.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

SUMMARY OF THE INVENTION

This invention resides in a universal tool includes a body with an opening adapted to interchangeably receive cassette-type work elements. Connected to the body is a handle containing clamping means for securing the work piece within the surfaces of the working elements of the cassette and a screw unit which preliminarily orients the working surfaces of the cassette elements in relation to the diameter or size of the work piece. The various cassettes can contain a screw driver, reamers, wrench, pipe flare, thread cutters and other functional working surfaces or jaws.

BRIEF DESCRIPTION OF THE DRAWING

In the accompanying drawing, in which is shown one of the various possible illustrative embodiments of this invention, wherein like reference character identify the same or like parts:

FIG. 17 is a perspective view showing how cassette is placed in wrench;

FIG. 18 is a perspective view of the removable handle;

FIG. 19 is a cross section through lines XIX—XIX of FIG. 2;

FIG. 20 is a sectional view showing operation of eccentric and screw adjustment units; and FIG. 21 is a front elevation of a cassette holding a punch or pipe flaring tool.

DESCRIPTION OF THE PREFERRED EMBODIMENTS

Figure 1:
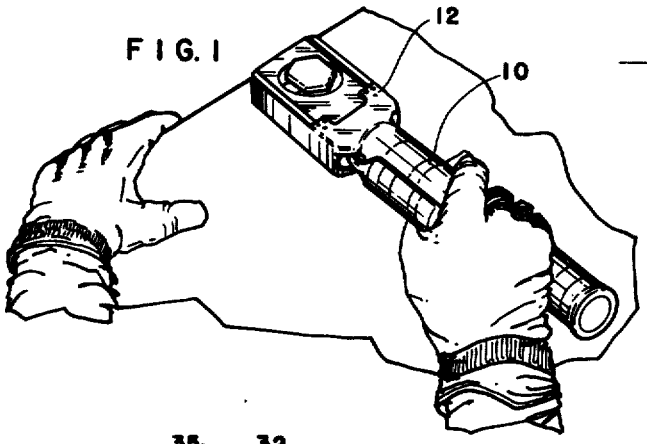
FIG. 1 is a perspective view showing the tool of the invention in use.

With reference to the drawing, there is shown and illustrated a universal tool with replaceable cassettes constructed in accordance with the principles of the invention and designated generally by reference character 10. The illustrated tangible embodiment of the invention includes as shown in FIGS. 1, 2, 17 and 20, a head 12 having a central cavity 14 of rectangular shape. Head 12 is secured by screws 13 to elongated hollow handle 16 and its cavity 14 communicates with the interior of handle 16 through bore 18 at one end. A threaded bore 20 is provided in the upper end of the head 12 which receives the threaded stem 22 of removable tubular handle 24.

A pair of lateral slides 26 are formed on the upper part of head 12 which receive sliding plate 28 fitting over cassette 30 constituting the heart of this invention and securing same in place in cavity 14 (FIG. 17). Plate 28 has a central opening 32 giving access to the working elements of the cassette 30 and is held in place by springs 29 (FIG. 2A). As shown in FIG. cassette 30 includes a pair of elongated guides 32 having secured in one end thereof by rivets 35 a stationary working surface 34 which in this example is angular. Compression springs 36 in recesses 38 drilled in the outer sides of surface 34 connect it to slidable working surface 40 which also has side bores 38 for connecting the other ends of springs 36 to urge the two surfaces together.

Figure 2:
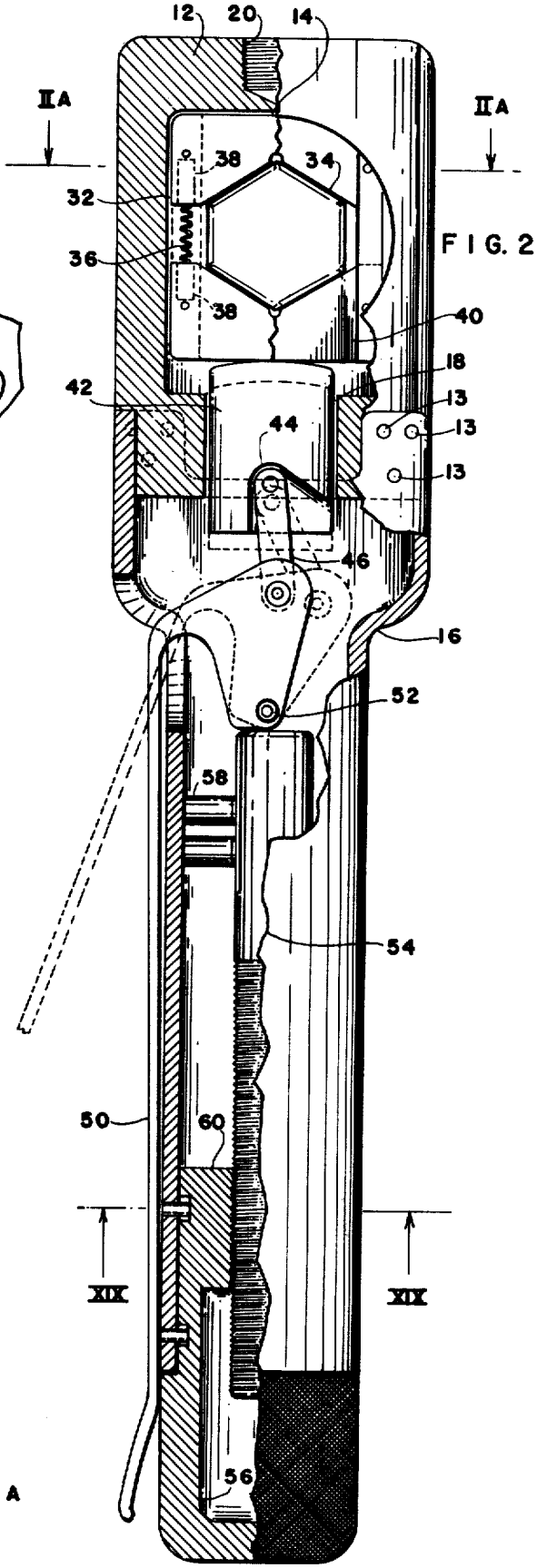
FIG. 2 is a partial section view to illustrate mechanism with phantom lines illustrating the cam movement.
Figure 3:
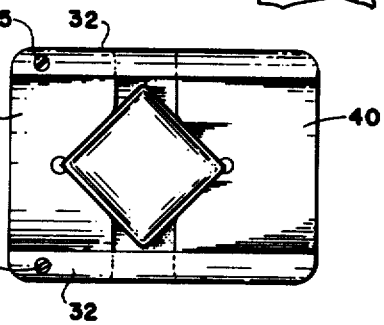
FIG. 3 is a top plan view of a wrench-type cassette.
Figure 2A:
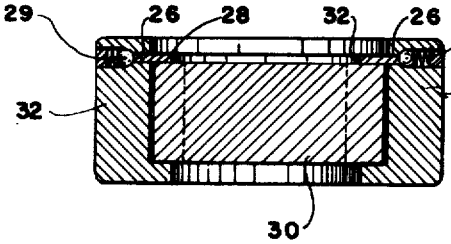
FIG. 2A is a cross section along lines IIA—IIA of FIG. 2.

As shown with greater clarity in FIGS. 2, 17 and 20, the straight-end of movable surface is contacted by one side of pusher 42 which is slidably mounted in opening 18. Pusher 42 includes a recess 44 (FIGS. 2, 20) in which is pivoted one end of link 46 whose other end is pivoted eccentrically on cam portion 48 of a handle 50 with the end of cam 48 pivoted by pin 52 to the end threaded screw stem 54 which is accessible through opening 56 and moves on threaded parts 58, 60 inside handle 16 and against the opposed threaded inner surface 62 of the handle. The screw unit performs preliminary orientation of the working surfaces of the cassette 30 in relation to the diameter or size of the work piece. Then convex handle 50 is pressed against handle 16 from its position shown in phantom lines in FIG. 2 to solidly clamp pusher 42 in place.

With the present tool, the entire load is equally distributed along all the working surfaces of the clamped work piece and not on separate points as in the prior art. In particular, a box wrench, spanner or universal wrench acts on several corner points of the nut or bolt head which causes crushing of the corners and damages the tool and work piece. The vertical edge in the corners along the entire thickness of the cassette equalizes pressure along all the surfaces of the working zones of the work piece (nut, bolt, etc.). Thus, avoiding such damage.

The FIGS. 4–16 and 21 show other embodiments of cassettes which can be used interchangeably in tool 10.

Figure 4:
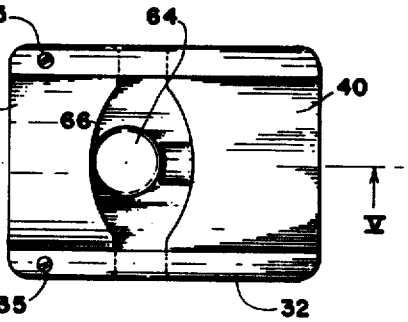
FIG. 4 is a top plan view of a pin fastening cassette.
Figure 5:
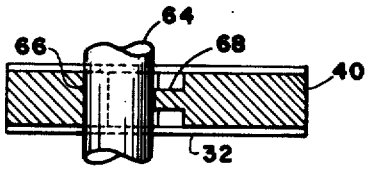
FIG. 5 is a view taken along section V—V of FIG. 4.

Thus, FIGS. 4, 5 show a cassette for fastening a pin 64 with stationary work surface 34 here having an arcuate pin contacting surface 66 while movable surface 40 has projection 68.

Figure 6:
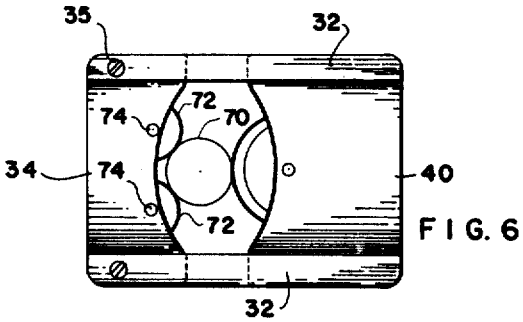
FIGS. 6 & 7 are the same as FIGS. 4 and 5 but for a tubing cutter cassette.
Figure 7:
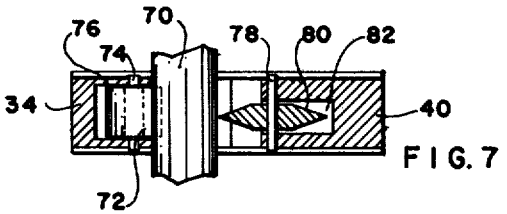

FIGS. 6, 7 show a cassette having tubing cutting means for cutting tube 70. Here fixed surface 34 has a pair of rollers 72 rotatably mounted on pins 74 in recesses 76 while cutting wheel 78 is journalled on shaft 80 in recess 82 of sliding member 40.

Figure 8:
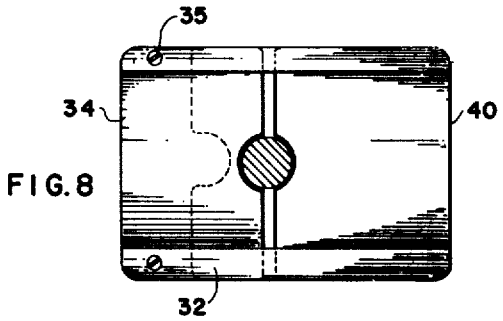
FIGS. 8 & 9 are the same as FIGS. 4 and 5 for a wire shear cassette.
Figure 9:
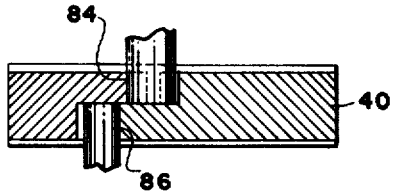

FIGS. 8, 9 illustrate a cassette having wire shearing means formed by two registering sharp, arcuate recesses 84, 86 in the working surfaces 34, 40 on different superimposed planes.

Figure 10:
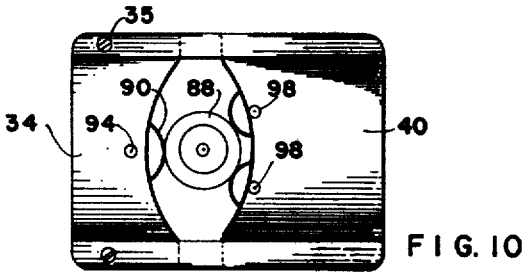
FIGS. 10 & 11 are the same as FIGS. 4 and 5 for a pipe rolling cassette.
Figure 11:
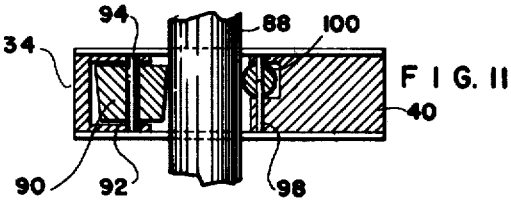

FIGS. 10, 11 show a cassette having pipe rolling means for a pipe 88. Pipe 88 is rolled between large upwardly flared roller 90 in recess 92 journalled on pin 94 of fixed surface 34 and smaller rollers 96 journalled on pins 98 in recesses 100 of movable surface 40.

Figure 12:
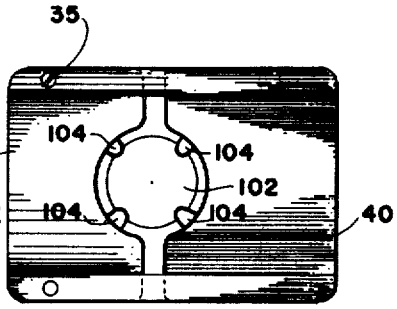
FIGS. 12 & 13 are the same as FIGS. 4 and 5 for a wire crimping cassette.
Figure 13:
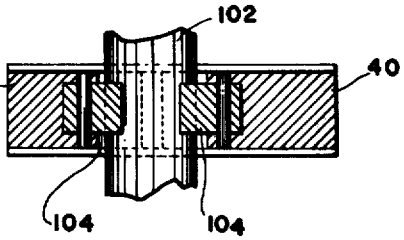

FIGS. 12 and 13 depict a cassette for crimping a wire 102 by means of crimps 104 integral with each of working surfaces 34 and 40.

Figure 14:
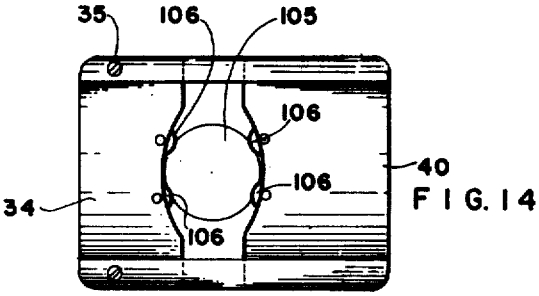
FIGS. 14 & 15 are the same as FIGS. 4 and 5 for rolling cassette for hydraulic hose to pipe connections.
Figure 15:
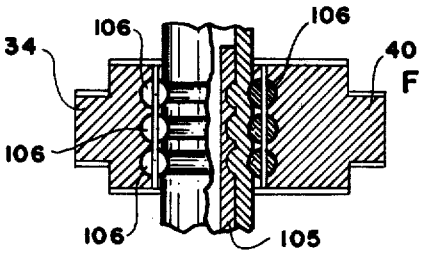

FIGS. 14 and 15 depict a cassette with means for crimping a pipe to a hydraulic hose connection 105. These include two rows of three rollers 106 equally spaced on surfaces 34 and 40.

Figure 16:
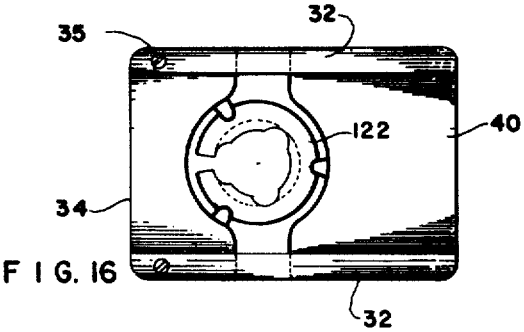
FIG. 16 is a top planar view of a thread cutting cassette.

FIG. 16 shows a thread cutting cassette with points 108 on each of surfaces 34 and 40.

FIGS. 21 and 16 show a pipe flaring cassette with punch 110 integral with slidable surface 40 at right angle thereto. Punch 110 includes a bracket 112 terminating in a pair of arms 114 with threaded openings in which threaded stem 116 rotated by knob 118 and at the end of which is fixed punch head 120 adapted to enter pipe 122 held between surfaces 34 and 40.

This tool is intended for use in the following operations:

1. Screwing and unscrewing of all types of bolts and nuts.
2. Cutting of exterior and internal threads.
3. Reaming of openings.
4. Fastening of pins of any profile.
5. Cutting of pins of any profile and of wires.
6. Pipe cutting.
7. Press clamping of wires with shoes.
8. Pipe rolling.
9. Pipe expansion.
10. Rolling and sealing of hydraulic and pneumatic hoses to pipe sleeves.

What is claimed is:

1. A universal tool including a hollow body portion and a head portion; a cavity in said head; a passageway communicating from said cavity to said body; a cassette-type work element removably mounted in said cavity; said element including spaced longitudinal guides enclosing fixed and slidable working surfaces connected by expansion springs; a pusher element slidably mounted in said passageway in contact with said slidable working surface a clamp including a cam pivoted at one end to said pusher element; a screw unit in said hollow body said cam being eccentrically mounted on said screw unit.

2. The invention as recited in claim 1, further including a handle removably mounted in said head.

3. The invention as recited in claim 1, wherein said working surfaces constitute a wrench.

4. The invention as recited in claim 1, wherein said fixed surface is arcuate and said slidable surface includes a block for fastening a fastening.

5. The invention as recited in claim 1, wherein said work element is a tube cutter.

6. The invention as recited in claim 1, wherein said work element is a pipe rolling tool.

7. The invention as recited in claim 1, wherein said work element is a wire crimping tool formed by superimposable, opposed abutting surfaces on said fixed and slidable working surfaces.

8. The invention as recited in claim 1, wherein said work element is a pipe flaring tool.

9. The invention as recited in claim 8, wherein said flaring tool includes a bracket fixed perpendicularly on said slidable working surface; a screw unit movably mounted on said bracket; said unit having a punch on the lower end thereof adapted to contact a pipe secured between said fixed working surface and said slidable working surface of said cassette-type work element.

10. The invention as recited in claim 1, further including lateral slides on each side of said cavity and a locking plate having a central opening slidably received in said slides above said cassette-type work element.

* * * * *